US011174058B2

(12) United States Patent
Luke et al.

(10) Patent No.: US 11,174,058 B2
(45) Date of Patent: Nov. 16, 2021

(54) SEAL REMOVAL STRUCTURE

(71) Applicant: Hewlett-Packard Development Company, L.P., Spring, TX (US)

(72) Inventors: Jeff Luke, Boise, ID (US); Sean Daniel Fitzgerald, Boise, ID (US); Mathew Lavigne, Boise, ID (US); Dean Richtsmeier, Boise, ID (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/968,368

(22) PCT Filed: May 15, 2018

(86) PCT No.: PCT/US2018/032779

§ 371 (c)(1),
(2) Date: Aug. 7, 2020

(87) PCT Pub. No.: WO2019/221710

PCT Pub. Date: Nov. 21, 2019

(65) Prior Publication Data

US 2021/0031959 A1 Feb. 4, 2021

(51) Int. Cl.

| | |
|---|---|
| ***B65B 69/00*** | (2006.01) |
| ***B41J 2/175*** | (2006.01) |
| ***B67D 3/00*** | (2006.01) |

(52) U.S. Cl.

CPC ..... *B65B 69/0041* (2013.01); *B41J 2/17506* (2013.01); *B67D 3/0061* (2013.01)

(58) Field of Classification Search

CPC ..... B65B 69/0041; B41J 2/17506; B41J 2/17523; B41J 2/17509; B67D 3/0061

See application file for complete search history.

(56) References Cited

U.S. PATENT DOCUMENTS

| | | | | |
|---|---|---|---|---|
| 4,990,964 | A | 2/1991 | Kraehn | |
| 5,090,582 | A * | 2/1992 | Art | B65D 51/225 215/226 |
| 5,920,333 | A | 7/1999 | Bates | |
| 6,079,823 | A | 6/2000 | Droege | |

(Continued)

FOREIGN PATENT DOCUMENTS

| | | | |
|---|---|---|---|
| CN | 1269749 | A | 10/2000 |
| CN | 101940532 | A | 1/2011 |

(Continued)

*Primary Examiner* — Jason K Niesz

(74) *Attorney, Agent, or Firm* — Staas & Halsey, LLP

(57) ABSTRACT

A seal removal structure can include a shell and a piercing member. The shell can have a first end section and a second end section. The first end section can be configured to receive a supply conduit of a supply fluid container and the second end section can be dimensioned to receive a receiving conduit of a container device. Additionally, the piercing member can be provided within the first end section to penetrate a seal of the supply conduit when the supply conduit is received by the first end section. Moreover, the piercing member can incise at least a portion of the seal from the supply conduit when the supply conduit or the piercing member rotates, while the supply conduit is received by the first end section.

20 Claims, 6 Drawing Sheets

(56) References Cited

U.S. PATENT DOCUMENTS

| | | | | |
|---|---|---|---|---|
| 6,089,391 | A * | 7/2000 | Abelbeck | B67B 7/24 215/228 |
| 6,264,316 | B1 | 7/2001 | Chino | |
| 7,410,071 | B1 * | 8/2008 | Seib | B65D 50/046 215/217 |
| 8,888,258 | B2 | 11/2014 | Kondou | |
| 9,339,439 | B2 * | 5/2016 | Nudo | A61J 1/2089 |
| 9,757,949 | B2 | 9/2017 | Yoshida | |
| 2002/0139441 | A1 | 10/2002 | Schoenfelder | |
| 2005/0011916 | A1 | 1/2005 | Batista | |
| 2007/0039975 | A1 * | 2/2007 | Bochtler | B65D 81/3211 222/142.5 |
| 2015/0057613 | A1 | 2/2015 | Clemente | |
| 2016/0089668 | A1 | 3/2016 | Ramstad | |
| 2016/0200110 | A1 | 7/2016 | Matsushita | |

FOREIGN PATENT DOCUMENTS

| | | | |
|---|---|---|---|
| CN | 103889388 | A | 6/2014 |
| CN | 203667969 | U | 6/2014 |
| CN | 105658257 | A | 6/2016 |
| EP | 0998393 | B1 | 12/2002 |
| EP | 1053876 | A2 | 2/2006 |
| JP | 59164148 | | 9/1984 |
| JP | 2003076122 | | 3/2003 |
| JP | 2009262570 | A | 11/2009 |
| WO | WO-2017020915 | A1 | 2/2017 |

* cited by examiner

SEAL REMOVAL STRUCTURE

CROSS REFERENCE TO RELATED APPLICATIONS

This application is a U.S. National Stage Application which claims the benefit under 35 U.S.C. § 371 of International Patent Application No. PCT/US2018/032779 filed on May 15, 2018, the contents of which are incorporated herein by reference.

BACKGROUND

Fluid ejection devices can include fluid storage components. In some examples, the fluid storage components can store ink. In other examples, these fluid storage components can store toner. In such examples, the fluid storage components can be refillable.

BRIEF DESCRIPTION OF THE DRAWINGS

The disclosure herein is illustrated by way of example, and not by way of limitation, in the figures of the accompanying drawings in which like reference numerals refer to similar elements, and in which.

Figure 1A:
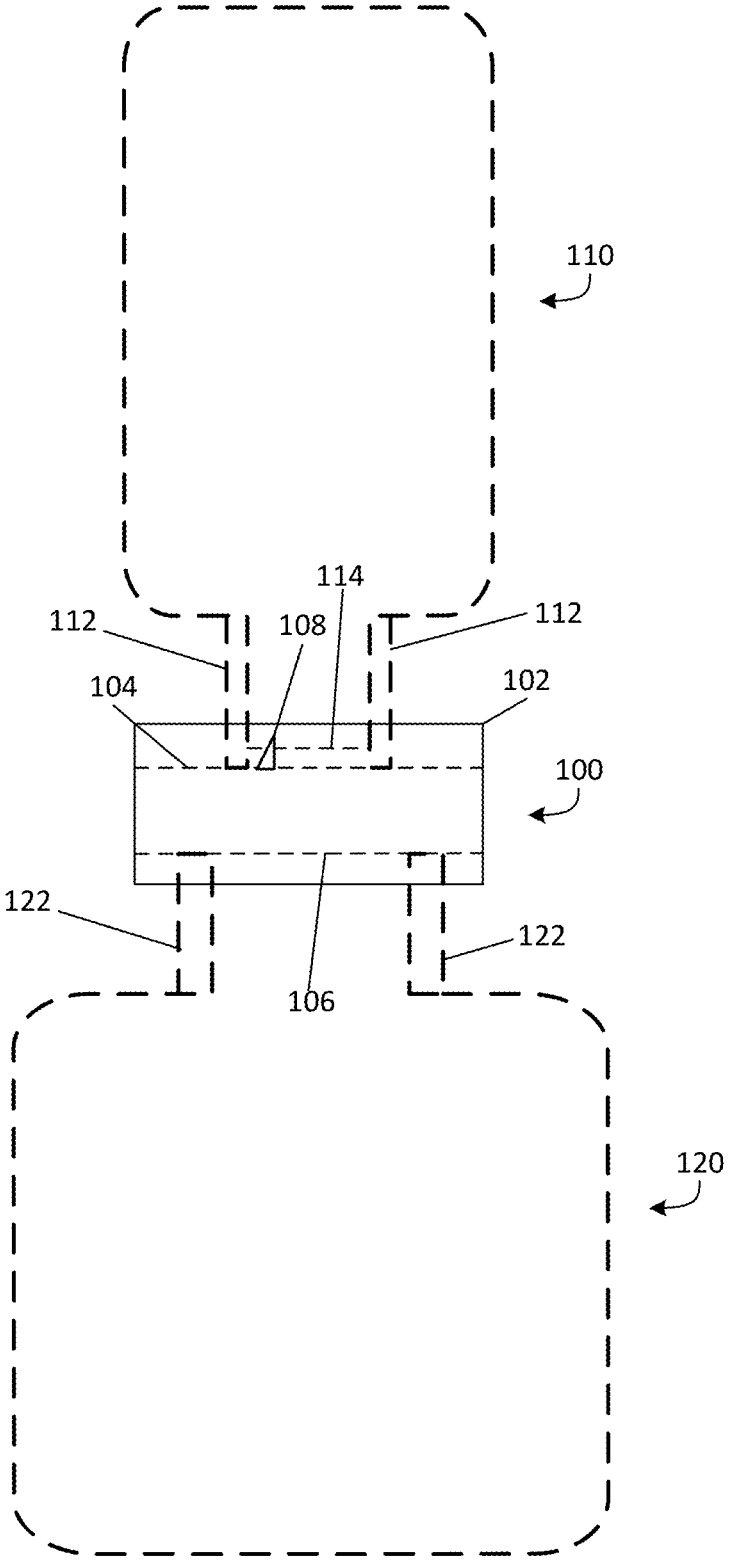
FIG. 1A illustrates an example cross-sectional view of a seal removal structure.

Throughout the drawings, identical reference numbers designate similar, but not necessarily identical elements. The figures are not necessarily to scale, and the size of some parts may be exaggerated to more clearly illustrate the example shown. Moreover, the drawings provide examples and/or implementations consistent with the description. However, the description is not limited to the examples and/or implementations provided in the drawings.

DETAILED DESCRIPTION

Examples provide for a seal removal structure with a shell and a piercing member that can alleviate or prevent spillage of fluidic material (e.g., ink or toner) during the transfer of fluidic material from a supply container to a container device. In some examples, the shell can include a first end section to receive a supply conduit of a supply container, and a second end section to receive a receiving conduit of a container device. Additionally, the piercing member can penetrate a seal of the supply conduit when the supply conduit is received by the first end section. Moreover, while the supply conduit is received by the first end section, the piercing member can incise or cut at least a portion of the seal when the supply conduit or the piercing member rotates. In some examples, the piercing member can create a long enough incision in the seal to create a flap. That way, the weight of the fluidic material in the supply container can cause the flap to open and allow the fluidic material to pass from the supply container into the container device.

Examples as described recognize that a seal removal structure can cause fluid or material to pass from a sealed conduit of a fluid container without the first removing the seal of the sealed conduit, prior to the engagement of the seal removal structure and the sealed conduit.

System Description

Figure 1B:
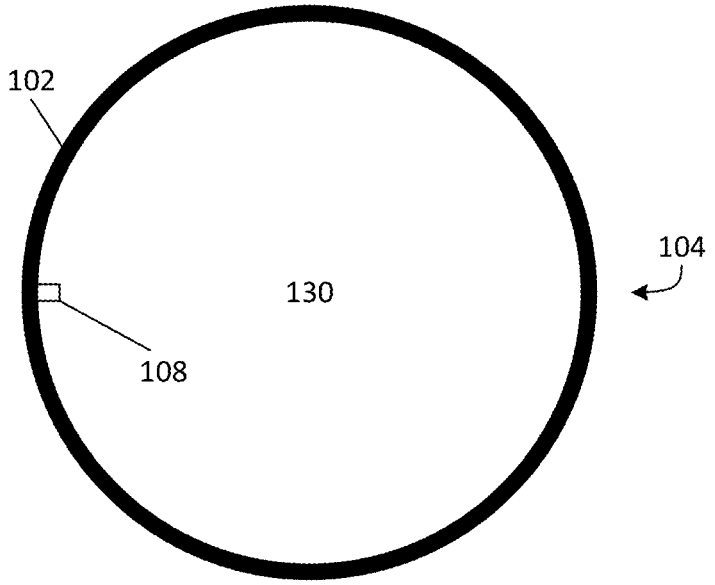
FIG. 1B illustrates an example top view of a seal removal structure.
Figure 1C:
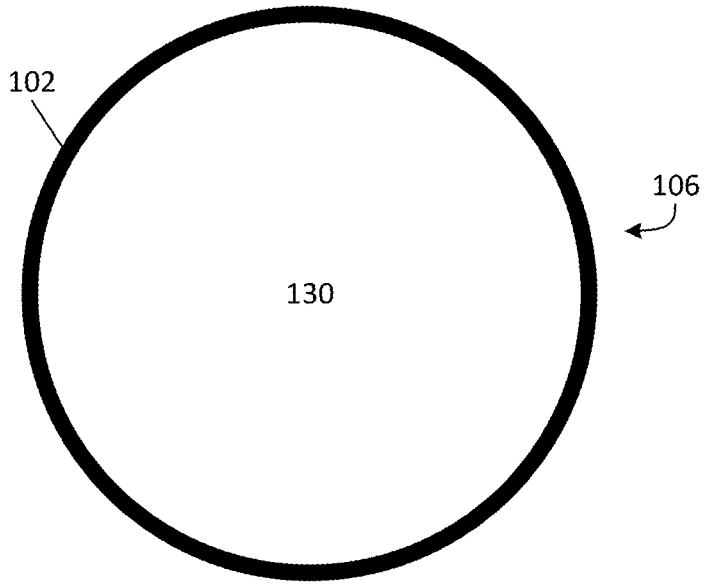
FIG. 1C illustrates an example bottom view of a seal removal structure.

FIG. 1A through FIG. 1C illustrate an example seal removal structure for mating a supply container to a container device. As shown by examples of FIG. 1A, seal removal structure 100 can be provided as a separate structure that can be coupled to or combined with container device 120 to facilitate transfer of fluidic material from supply container 110 to the container device 120.

According to examples, the container device 120 includes any device that is structured to receive, retain and use a fluidic material, where the fluidic material can exist in liquid, gas or solid form when transferred. Supply container 110 can correspond to any container that retains fluidic material for supplying the container device 120. In examples, container device 120 can correspond to an ink cartridge, and supply container 110 can supply liquid fluidic material in the form of ink. In variations, the container device 120 can correspond to a toner cartridge, and the supply container 110 can supply solid (e.g., fine powder) fluidic material in the form of toner.

FIG. 1A, illustrates an example cross-sectional view of a seal removal structure. As shown, seal removal structure 100 can include shell 102 and piercing member 108. Seal removal structure 100 can include first end section 104 and a second end section 106. In some examples, shell 102 can have a thickness that defines an opening at first end section 104 and an opening at second end section 106. In such examples, seal removal structure 100 can include a conduit that extends from the opening of first end section 104 to the opening of second end section 106. Additionally, the opening of first end section 104 can be dimensioned to receive supply conduit 112 of supply container 110 and the opening of second end section 106 can be dimensioned to receive receiving conduit 122 of container device 120. In such examples, the opening of first end section 104 can be dimensioned larger than supply conduit 112 and the opening of second end section 106 can be dimensioned larger than receiving conduit 122 of container device 120.

Piercing member 108 can be supported at a depth distance within a conduit extending from first end section 104 to second end section 106. For example, piercing member 108 can extend from a depth distance from an opening of first end section 104, such that piercing member 108 can penetrate seal 114 of supply conduit 112, when supply conduit 112 is received by first end section 104. In some examples, piercing member 108 may extend from an interior surface of the conduit to engage seal 114 of supply conduit 112.

As described, seal removal structure 100 can enable supply container 110 to mate with container device 120, in a manner that enables seal 114 of supply container 110 to be removed by the user performing an action (e.g., twist action), or series of actions (e.g., series of twist actions) to mate supply container 110 with container device 120. In this way, seal removal structure 100 can remove seal 114 of supply container 110 after supply container 110 and container device 120 are aligned and physically engaged. This allows for the removal of seal 114 of supply container 110 to be accompanied by transfer of fluidic material along the respective conduits (e.g., supply conduit 112 and receiving conduit 122) of container device 120 and supply container 110. Among other benefits, the use of the seal removal structure 100 can prevent spillage that would otherwise result from the user having to remove a seal from a supply container before aligning and coupling the supply container to the container device. As herein described, any fluidic material (e.g., ink or toner), can be pass through seal removal structure 100 (e.g., through a conduit of seal removal structure 100).

FIG. 1B and FIG. 1C illustrate an example top and bottom view of seal removal structure 100 of FIG. 1A. FIG. 1B illustrates an example top view of a seal removal structure or a top-down view of first end section 104 of FIG. 1A. As shown in FIG. 1B, seal removal structure 100 include shell 102 and piercing member 108. In some examples, seal removal structure 100 can include a conduit that extends from first end section 104 to second end section 106. Such a conduit, conduit 130, is illustrated in FIG. 1B. FIG. 1C illustrates an example bottom view of a seal removal structure or a bottom-up view of second end section 106 of FIG. 1A. As shown in FIG. 1C, seal removal structure 100 includes shell 102 and conduit 130.

Figure 2:
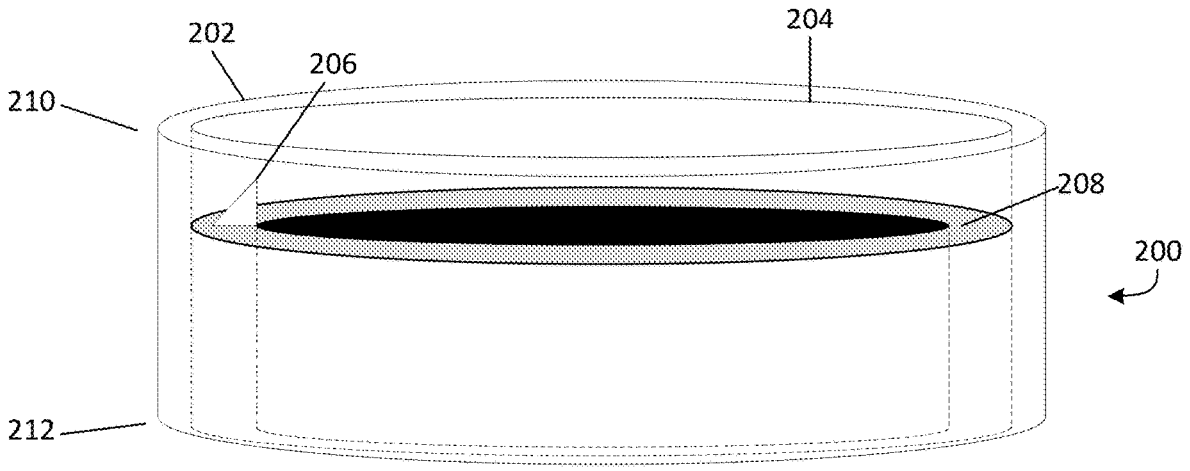
FIG. 2 illustrates an example seal removal structure with a shelve structure.

In some examples, a seal removal structure can include a shelving structure within a conduit of a seal removal structure's shell that a piercing member can be coupled to. FIG. 2 illustrates an example seal removal structure with a shelve structure. As shown in FIG. 2, seal removal structure 200 can include shell 202, conduit 204, shelving structure 208 with piercing member 260 affixed to shelving structure 208.

As illustrated in FIG. 2, shell 202 can include first end section 210 and second end section 212. Additionally, shell 202 can have a thickness that defines an opening at first end section 210 and an opening at second end section 212 with conduit 204 extending from the opening of first end section 210 to the opening of second end section 212. The opening at first end section 210 can be dimensioned to receive a supply conduit of a supply container and the opening at second end section 212 can be dimensioned to receive a receiving conduit of a container device. In some examples, the opening at first end section 210 can be dimensioned larger than a supply conduit of a supply container and the opening at the second end section 212 can be dimensioned larger than a receiving conduit of a container device.

Shelving structure 208 with piercing member 206 can be positioned within conduit 204. In some examples, shelving structure 208 with piercing member 206 can be at a depth distance below the opening at first end section 210. That way, piercing member 206 can penetrate a seal of a supply container when the supply container mates or is received by the opening at first end section 210. For example, the supply container can mate with seal removal structure 200 in a manner that enables a seal of the supply container to be removed by the user performing an action (e.g., twist action), or series of actions (e.g., series of twist actions). Additionally, seal removal structure 200 can remove the seal of the supply container after the supply container is engaged with seal removal structure 200 (e.g., after piercing member 206 penetrates the seal of the supply container). This allows for the removal of the seal of the supply container to be accompanied by transfer of fluidic material through conduit 204. In some examples, piercing member 206 can be conical in shape. In other examples, piercing member 206 can be a blade.

In some examples, a seal of a supply container can be removed by being incised or cut by a stationary piercing member 206. In such examples, shelving structure 208 is affixed to an interior wall of conduit 204 and conduit 204 can include a retaining feature located at first end section 210. The retaining feature can enable a sealed supply container to mate with seal removal structure 200 with application of a corresponding mating action. For example, the retaining feature can be a thread and the sealed conduit can be shaped to include a corresponding thread. The thread retaining feature can extend to a portion of conduit 204 such that screwing or rotating the sealed supply container to mate with seal removal structure 200 can cause the seal of the supply container to be punctured and incised by the stationary piercing member 206.

In other examples, piercing member 206 can incise or cut a seal of a supply container by rotating piercing member 206 within conduit 204, while the supply container is locked within seal removal structure 200. In such examples, seal removal structure 200 can include a bearing system to allow shelving structure 208 to rotate within conduit 204. For example, shelving structure 208 can be a shaft with a smaller circumference than conduit 204 that includes ball bearings to provide rotational movement around a fixed axis within conduit 204. Additionally, conduit 204 can include a retaining feature to secure the supply container within conduit 204 so that shelving structure 208 with piercing member 206 can rotate and incise or cut the seal of the supply container.

Figure 3:
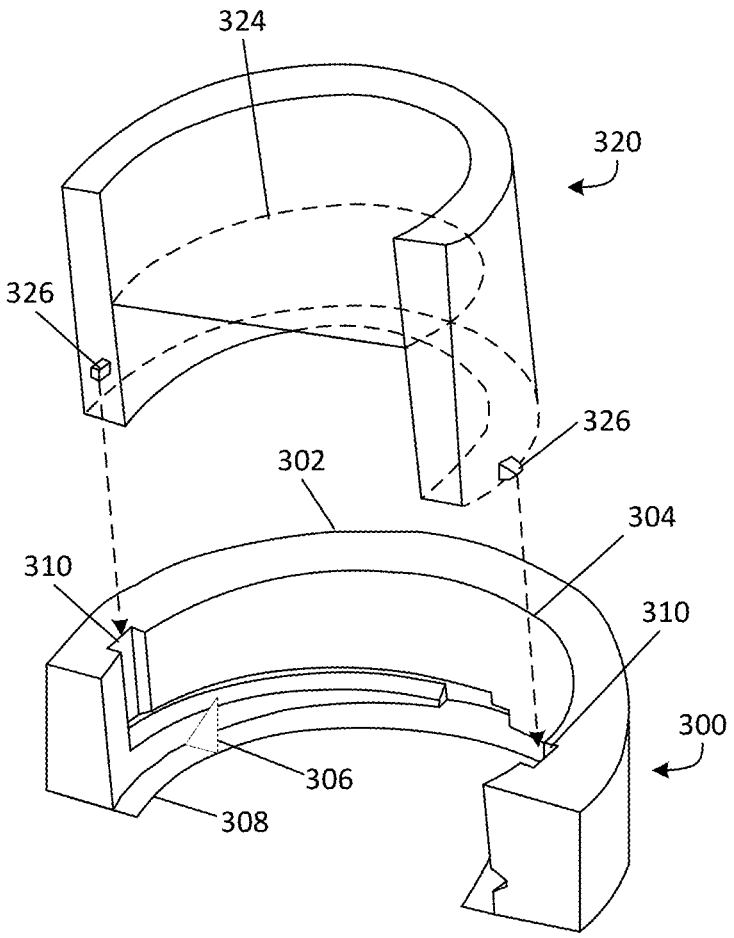
FIG. 3 illustrates an example three-dimensional cross-sectional view of an example seal removal feature with a retaining structure.

FIG. 3 illustrates an example three-dimensional cross-sectional view of an example seal removal structure with a retaining feature. As illustrated in FIG. 2, first end section of seal removal structure 300 includes shell 302 with conduit 304 and piercing member 306 affixed to a top face of shelving structure 308. Additionally, first end section of seal removal structure 300 can include retaining feature 310. In some examples and as illustrated in FIG. 3, first end section of seal removal structure 300 can include multiple retaining features 310. Retaining feature 310 can include a track that can be shaped to allow mating elements 326 of sealed conduit 320 of a supply container to lock into and move on a predetermined path within conduit 304. For example, as illustrated in FIG. 3, retaining feature 310 can have an "L-shaped" track with a vertical portion and a horizontal portion. The vertical portion of the "L-shaped" track can enable sealed conduit 320 to travel within conduit 304 towards piercing member 306. At the bottom of the vertical portion of the "L-shaped" track, piercing member 306 can puncture seal 324 of sealed conduit 320. Additionally, sealed conduit 320 with mating element 326 can rotate around a fixed axis by traveling along the horizontal portion of the "L-shaped" track. In some examples, the horizontal portion can be of a predetermined pitch, to allow for further vertical translation as sealed conduit 320 with mating element 326 rotates about the fixed axis. That way, piercing member 306 can incise or cut seal 324 of sealed conduit 320. In some examples, as illustrated in FIG. 3, the horizontal portion of the "L-shaped" track can extend to a portion of the circumference of conduit 304 to restrict the rotational movement of sealed conduit 320.

Figure 4:
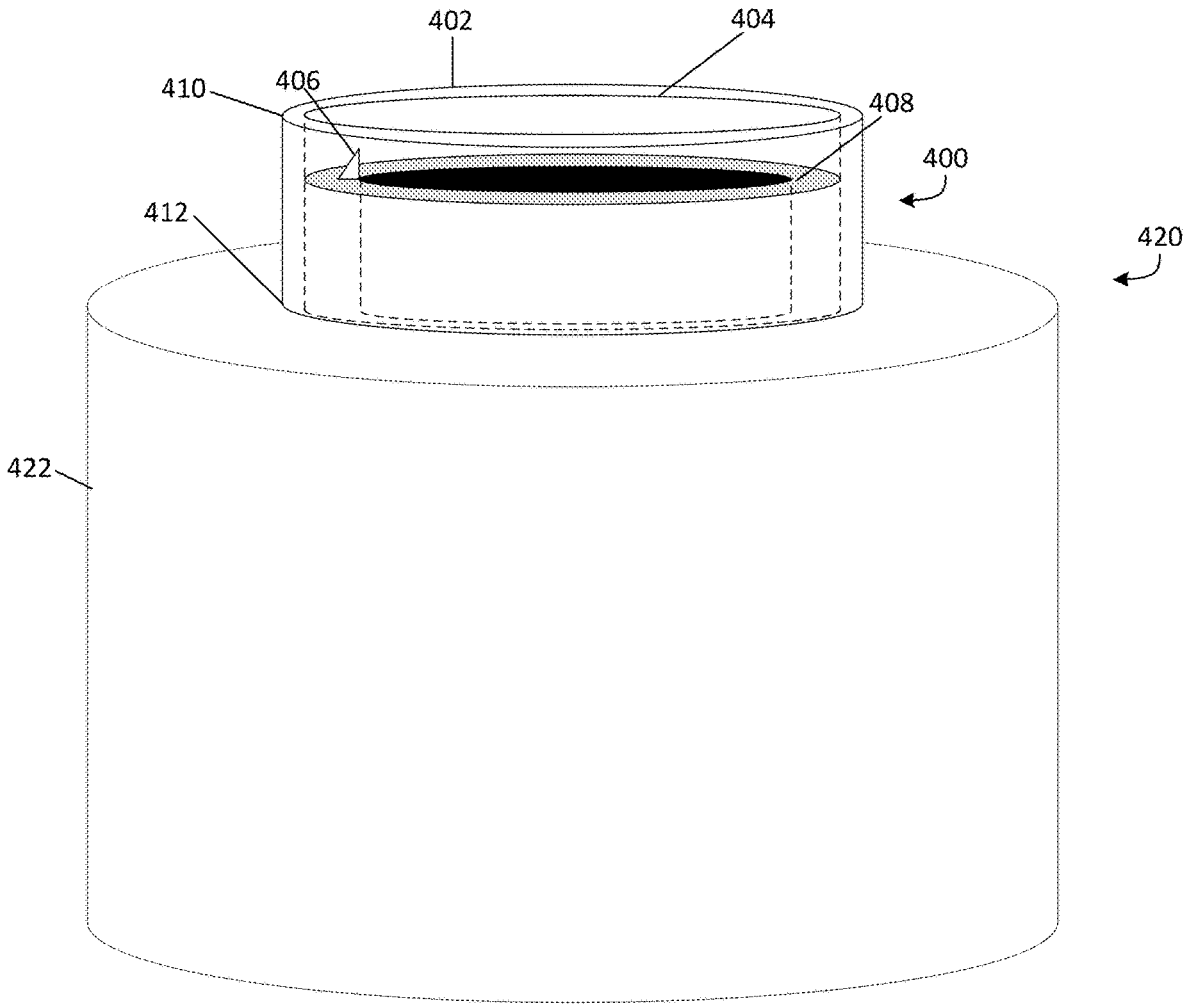
FIG. 4 illustrates an example receiving fluid container including an example seal removal structure.

In some examples, a container device, such as a receiving fluid container can include a seal removal structure. FIG. 4 illustrates an example receiving fluid container including an example seal removal structure. As illustrated in FIG. 4, receiving fluid container 420 can include seal removal structure 400 like seal removal structure 200 of FIG. 2. Receiving fluid container 420 can include retaining structure 422 to provide a fluid reservoir. Additionally, conduit 404 can extend from an opening at first end section 410, to the opening at second end section 412 and to the fluid reservoir of receiving fluid container 420.

Shelving structure 408 with piercing member 406 can be positioned within conduit 404. In some examples, shelving structure 408 with piercing member 406 can be at a depth distance below the opening at first end section 410. That way, piercing member 406 can penetrate a seal of a supply container when the supply container mates or is received by the opening at first end section 410. For example, the supply container can mate with seal removal structure 400 in a manner that enables a seal of the supply container to be removed by the user performing an action (e.g., twist action), or series of actions (e.g., series of twist actions). Additionally, seal removal structure 400 can remove the seal of the supply container after supply container is engaged with seal removal structure 400 (e.g., after piercing member 406 penetrates the seal of the supply container).

In some examples, a seal of a supply container can be removed by being incised or cut by a stationary piercing member 406. In such examples, shelving structure 408 is affixed to an interior wall of conduit 404 and conduit 404 can include a retaining feature located at first end section 410. The retaining feature can enable a sealed supply container to mate with seal removal structure 400 with application of a corresponding mating action. For example, the retaining feature can be a thread and the sealed conduit can be shaped to include a corresponding thread. The thread retaining feature can extend to a portion of conduit 404 such that screwing or rotating the sealed supply container to mate with seal removal structure 400 can cause the seal of the supply container to be punctured and incised by the stationary piercing member 406.

In other examples, piercing member 406 can incise or cut a seal of a supply container by rotating piercing member 406 within conduit 404, while the supply container is locked within seal removal structure 400. In such examples, seal removal structure 400 can include a bearing system to allow shelving structure 408 to rotate within conduit 404. For example, shelving structure 408 can be a shaft with a smaller circumference than conduit 404 that includes ball bearings to provide rotational movement around a fixed axis within conduit 404. Additionally, conduit 404 can include a retaining feature to secure the supply container within conduit 404 so that shelving structure 408 with piercing member 406 can rotate and incise or cut the seal of the supply container.

Seal removal structure 400 of receiving fluid container 420 can alleviate and prevent fluids spilling from a fluid container during the transfer of fluids from the fluid container to receiving fluid container 420. For example, the opening at first end section 410 can be dimensioned to receive a supply conduit of a supply container and the opening at second end section 212 can be coupled to receiving fluid container 420. In some examples, the opening at first end section 210 can be dimensioned larger than a supply conduit of a supply container. Additionally, seal removal structure 400 can enable the supply container 110 to mate with receiving fluid container 420, in a manner that enables a seal of the supply container to be removed by the user performing an action (e.g., twist action), or series of actions (e.g., series of twist actions) to mate the supply container with receiving fluid container 420. In this way, seal removal structure 400 can remove the seal of the supply container after the supply container and receiving fluid container 420 are aligned and physically engaged. This allows for the removal of the seal of the supply container to be accompanied by transfer of fluidic material from the supply container, through conduit 404 and into a fluid reservoir of retaining structure 422.

Figure 5:
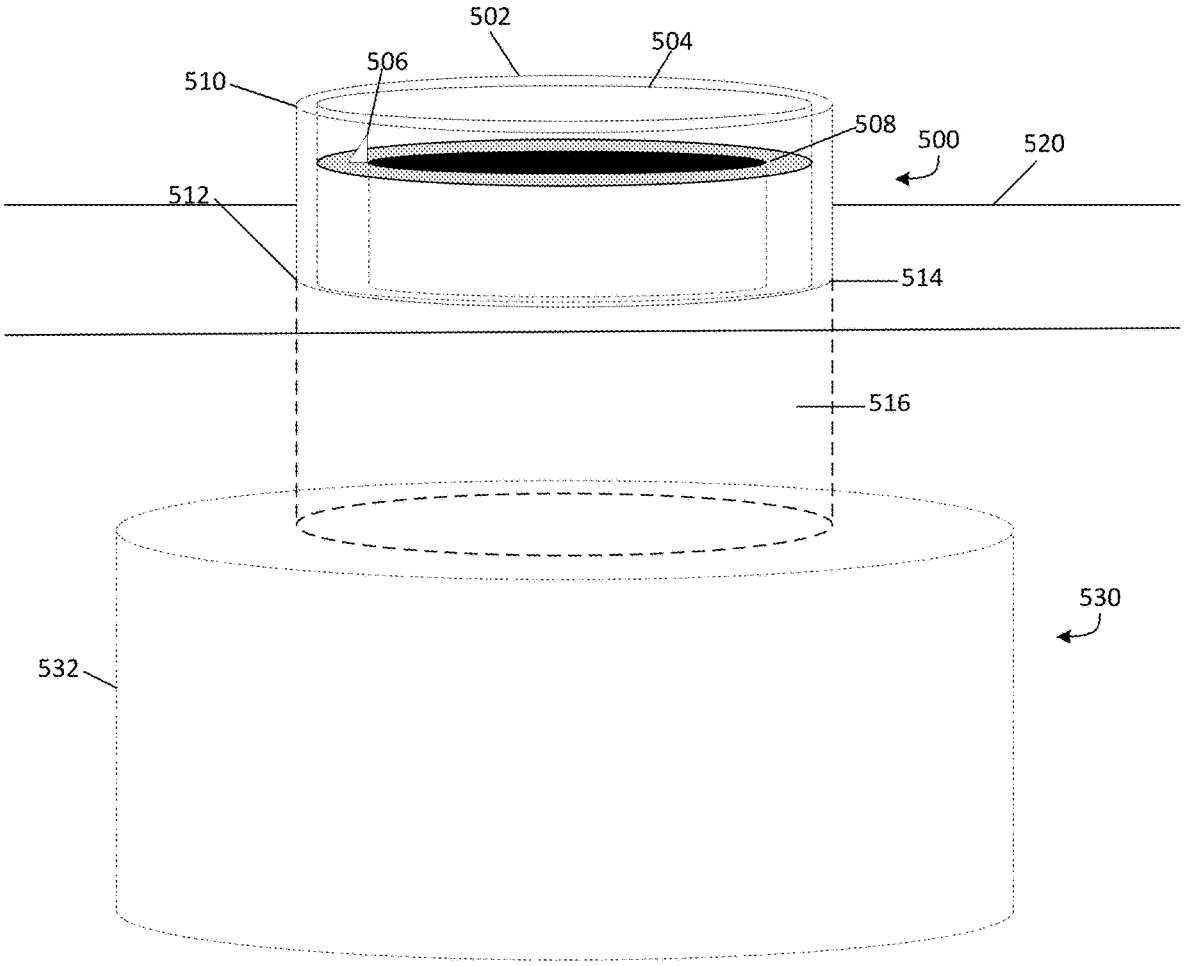
FIG. 5 illustrates an example fluid ejection device with an example receiving fluid container and an example seal removal structure.

In some examples, a container device, such as a fluid ejection device (e.g., a printer device) can include a receiving fluid container and a seal removal structure. FIG. 5 illustrates an example fluid ejection device with an example receiving fluid container and an example seal removal structure. As illustrated in FIG. 5, fluid ejection device 520 can include seal removal structure 500 and receiving fluid container 530 with retaining structure 532 to provide a fluid reservoir. Seal removal structure 500 can be similar to seal removal structure 200 of FIG. 2.

In some examples, fluid ejection device 520 can include a port 514 and port 514 can include port conduit 516 that extends from port 514 to receiving fluid container 530. In such examples, port 514 can be an opening on the surface of fluid ejection device 520. Additionally, in such examples, seal removal structure 500 can include shell 502 and conduit 504 of seal removal structure 500 can extend from an opening at first end section 510 to an opening at second end section 512. Shell 502 at second end section 512 can be coupled to port 514. That way, fluidic material can travel through seal removal structure 500, through conduit 504 and port conduit 516 into receiving fluid container 530. Moreover, receiving fluid container 530 can include retaining structure 532 to provide a fluid reservoir for fluid that has passed through seal removal structure 500 and port conduit 516.

Seal removal structure 500 of fluid ejection device 520 can alleviate and prevent fluids spilling from a supply fluid container during the transfer of fluids from a supply fluid container to receiving fluid container 530. For example, shell 502 can include an opening at first end section that can be dimensioned to receive a sealed conduit of a supply container with application of a corresponding mating action (e.g., a twist action or a series of twist actions). Additionally, conduit 504 can include piercing member 506. Piercing member 506 can be positioned within conduit 504 such that piercing member 506 can penetrate the sealed conduit of the supply fluid container when the mating end of shell 502 mates with the sealed conduit. For example, as illustrated in FIG. 5, piercing member 506 can be coupled to shelving structure 508 at a depth distance below the opening at first end section 410. That way, piercing member 506 can penetrate a seal of a supply container when the supply container mates or is received by the opening at first end section 510. Moreover, in some examples, piercing member 506 can remove a seal of the sealed conduit by cutting or incising the seal once the piercing member 506 penetrates the sealed conduit. In such examples, once piercing member 506 has created a long enough incision in the sealed conduit a flap is created. That way, the weight of the fluidic material in the supply fluid container can cause the flap to open and allow the fluidic material to pass from the supply fluid container into retaining structure 532 of receiving fluid container 530 through seal removal structure 500, port 514 and port conduit 516.

In some examples, a sealed conduit of a supply container can be incised or cut by a stationary piercing member 506. In such examples, shell 502 can include a retaining feature located on at first end section 510. The retaining feature can enable a sealed conduit of a fluid container to mate with seal removal feature 500 with application of a corresponding mating action. For example, the retaining feature can be a thread and the sealed conduit can be shaped to include a corresponding thread. The thread retaining feature can extend to a portion of conduit 504 such that screwing or rotating the supply container to mate with seal removal structure 500 can cause a seal of the sealed conduit to be punctured and incised by the stationary piercing member 506.

In other examples, piercing member 506 can incise or cut the sealed conduit by rotating within conduit 504, while a sealed conduit of supply container and shell 502 are locked into position with one another. In such examples, shelving structure 508 can include a bearing system to allow piercing member 506 coupled to shelving structure 508 to rotate within conduit 504. For example, shelving structure 508 a bearing element (e.g., a shaft with a smaller circumference than conduit 504 that includes ball bearings) to provide rotational movement around a fixed axis within conduit 504, while shell 502 stays in place. Additionally, conduit 504 can include a retaining feature to secure the sealed conduit of the supply container within conduit 504 so that piercing member 506 can incise or cut the sealed conduit.

Although specific examples have been illustrated and described herein, it will be appreciated by those of ordinary skill in the art that a variety of alternate and/or equivalent implementations may be substituted for the specific examples shown and described without departing from the scope of the disclosure. This application is intended to cover any adaptations or variations of the specific examples discussed herein.

What is claimed is:

1. A seal removal structure comprising:

a shell including a first end section to receive a supply conduit of a supply fluid container, and a second end section to receive a receiving conduit of a container device; and a piercing member provided within the first end section to (i) penetrate a seal of the supply conduit when the supply conduit is received by the first end section, and (ii) while the supply conduit is received by the first end section, incise at least a portion of the seal from the supply conduit when the piercing member rotates.

2. The seal removal structure of claim 1, wherein the receiving conduit includes a port and the container device is a fluid ejection device.

3. The seal removal structure of claim 2, wherein the fluid ejection device includes a receiving fluid container, and wherein the receiving conduit extends from the port to a fluid reservoir of a receiving fluid container.

4. The seal removal structure of claim 1, further comprising:

a conduit extending from the first end section to the second end section.

5. The seal removal structure of claim 4, further comprising:

a rotatable component positioned within the conduit of the shell, wherein the rotatable component includes a conduit and the piercing member.

6. The seal removal structure of claim 4, further comprising:

a shelving structure rotatable and positioned within the conduit of the shell, wherein the shelving structure includes the piercing member.

7. The seal removal structure of claim 4, wherein the conduit of the shell further includes a retaining feature to secure the supply conduit of the supply fluid container.

8. The seal removal structure of claim 7, wherein the retaining feature includes a thread component.

9. A fluid ejection device comprising:

a receiving conduit;

a receiving fluid container including a retention structure providing a fluid reservoir;

a seal removal structure including:

a shell including a first end section to receive a supply conduit of a supply fluid container, and a second end section to receive the receiving conduit; and a piercing member provided within the first end section to (i) penetrate a seal of the supply conduit when the supply conduit is received by the first end section, and (ii) while the supply conduit is received by the first end section, incise at least a portion of the seal from the supply conduit when the piercing member rotates.

10. The fluid ejection device of claim 9, wherein the receiving conduit extends from the fluid reservoir of the receiving fluid container.

11. The fluid ejection device of claim 9, wherein the receiving conduit includes a port that engages with the second end section of the seal removal structure.

12. The fluid ejection device of claim 9, wherein the seal removal structure includes:

a conduit extending from the first end section to the second end section.

13. The fluid ejection device of claim 12, wherein the seal removal structure further includes:

a rotatable component positioned within the conduit of the shell, wherein the rotatable component includes a conduit and the piercing member.

14. The fluid ejection device of claim 12, wherein the seal removal structure further includes:

a shelving structure rotatable and positioned within the conduit of the shell, wherein the shelving structure includes the piercing member.

15. The fluid ejection device of claim 9, wherein the conduit of the shell further includes a retaining feature to secure the supply conduit the supply fluid container into a first position.

16. The fluid ejection device of claim 15, wherein the retaining feature includes a thread component.

17. The receiving fluid container of claim 15, wherein the conduit of the shell further includes a retaining feature to secure the supply conduit of the supply fluid container into a first position, and wherein the retaining feature includes a thread component.

18. A receiving fluid container, comprising:

a retention structure providing a fluid reservoir;

a seal removal structure including:

a shell including a first end section to receive a supply conduit of a supply fluid container, and a second end section to receive the receiving conduit of a container device; and a piercing member provided within the first end section to (i) penetrate a seal of the supply conduit when the supply conduit is received by the first end section, and (ii) while the supply conduit is received by the first end section, incise at least a portion of the seal from the supply conduit when the piercing member rotates.

19. The receiving fluid container of claim 18, wherein seal removal structure includes:

a conduit extending from the first end section to the second end section.

20. The receiving fluid container of claim 19, wherein seal removal structure further includes:

a rotatable component positioned within the conduit of the shell, wherein the rotatable component includes the piercing member.

* * * * *